US008381773B2

(12) United States Patent
Sho et al.

(10) Patent No.: US 8,381,773 B2
(45) Date of Patent: Feb. 26, 2013

(54) THREAD FEEDING METHOD, WARP THREAD FEEDING METHOD, THREAD FEEDER AND WEAVING METHOD

(76) Inventors: JinSoo Sho, Seoul (KR); SunHo Sho, Seoul (KR)

( * ) Notice: Subject to any disclaimer, the term of this patent is extended or adjusted under 35 U.S.C. 154(b) by 0 days.

(21) Appl. No.: 12/736,531

(22) PCT Filed: Apr. 16, 2009

(86) PCT No.: PCT/KR2009/001971

§ 371 (c)(1),
(2), (4) Date: Oct. 15, 2010

(87) PCT Pub. No.: WO2009/128659

PCT Pub. Date: Oct. 22, 2009

(65) Prior Publication Data

US 2011/0023992 A1 Feb. 3, 2011

(30) Foreign Application Priority Data

Apr. 16, 2008 (KR) ..... 10-2008-0035381

(51) Int. Cl.
*D03C 3/20* (2006.01)
*D03C 13/00* (2006.01)

(52) U.S. Cl. ..... 139/55.1; 139/35; 139/59; 139/65

(58) Field of Classification Search ..... 139/35, 139/55.1, 59–65

See application file for complete search history.

(56) References Cited

U.S. PATENT DOCUMENTS 2,009,317 A * 7/1935 Hays ..... 139/319
3,780,775 A * 12/1973 Sprague ..... 139/453
3,871,419 A * 3/1975 Pfarrwaller ..... 139/114
4,172,475 A * 10/1979 Schwarz et al. ..... 139/66 R
4,326,566 A * 4/1982 Lampaert ..... 139/453
4,566,499 A * 1/1986 Kitagawa et al. ..... 139/59
5,200,904 A * 4/1993 Tottman ..... 700/131
5,601,671 A * 2/1997 Speich ..... 156/88
5,829,487 A * 11/1998 Thomas et al. ..... 139/319
5,911,247 A * 6/1999 Waters ..... 139/455
6,082,412 A * 7/2000 Wildeman et al. ..... 139/1 R
6,105,628 A * 8/2000 Duhamel ..... 139/455
6,185,475 B1 * 2/2001 Chung ..... 700/131
6,390,143 B1 * 5/2002 Speich ..... 139/1 R
6,520,216 B2 * 2/2003 Corbiere ..... 139/1 R (Continued)

OTHER PUBLICATIONS http://oxforddictionaries.com/definition/comb.*

(Continued)

*Primary Examiner* — Bobby Muromoto, Jr.

(74) *Attorney, Agent, or Firm* — Inventa Capital PLC

(57) ABSTRACT

Disclosed is a thread feeding method (the method) for feeding threads to a weaver. The method includes a step of feeding a multiplicity of strands of yarns with intervals to each line of the thread feed lines, while some strands of the multiplicity of strands of yarns are being separated from the other strands according to color or shade to be expressed at spots where they are either woven or knitted and are then fed to the weaver such that the colors or shades of the separated strands are combined to express target colors or shades at the spots where the strands are woven or knitted. The method of the present invention allows changing of colors or black and white shades of the threads being fed to the weaver. The method also allows the strands to be combined with other strands of yarns with different colors to express tens or hundreds of colors on a fabric.

12 Claims, 8 Drawing Sheets

U.S. PATENT DOCUMENTS

| | | | | |
|---|---|---|---|---|
| 7,072,733 | B2 * | 7/2006 | Magee et al. | 700/133 |
| 7,212,880 | B2 * | 5/2007 | Mizuno et al. | 700/138 |
| 7,272,244 | B2 * | 9/2007 | Saporiti et al. | 382/111 |
| 7,607,324 | B2 * | 10/2009 | Lonati | 66/205 |
| 8,050,791 | B2 * | 11/2011 | Li | 700/133 |
| 2003/0139840 | A1 * | 7/2003 | Magee et al. | 700/133 |
| 2004/0027623 | A1 * | 2/2004 | Saporiti et al. | 358/527 |
| 2005/0081945 | A1 * | 4/2005 | Bertolone | 139/452 |
| 2005/0182508 | A1 * | 8/2005 | Niimi et al. | 700/138 |
| 2009/0126823 | A1 * | 5/2009 | Yengkhom | 139/450 |

OTHER PUBLICATIONS http://textileglossary.com/reed.*

* cited by examiner

THREAD FEEDING METHOD, WARP THREAD FEEDING METHOD, THREAD FEEDER AND WEAVING METHOD

RELATED APPLICATION

This application claims priority to International application serial number PCT/KR2009/001971 filed on Apr. 16, 2009 that claims priority to Korean Patent application number 10-2008-0035381 filed on Apr. 16, 2008 and incorporated herewith by reference in its entirety.

TECHNICAL FIELD

The present invention relates to a thread feeding method for feeding threads to a weaving machine, a warp thread feeding method, a weaving method, and a thread feeder for realizing them.

BACKGROUND ART

In general, in order to express figures or letters by threads on fabrics, a method for laying embroidery on woven fabrics, or a method for alternately feeding threads during the weaving of fabrics is used.

From among such conventional methods, in a method for feeding threads to respective lines, a strand of thread made by combining several strands of yarn with a certain color is fed into each of the lines, and thus in order to change a color of the thread fed into the line, the thread itself has to be changed. However, there is a disadvantage in that it is impossible to express various colors because the number of strands of thread capable of being replaced in a warp feeding line is limited.

Also, in the conventional method for expressing figures or letters on fabrics, there is no other way than to express colors as many as the number of used threads' colors.

SUMMARY OF THE INVENTION

DISCLOSURE

Technical Problem

An objective of the present invention is to provide a method of fabricating threads with various colors or concentrations.

Another objective of the present invention is to provide a thread feeding method in which a color or a concentration of a thread can be changed as required during feeding of threads to a textile machine in the same thread feeding line.

Still another objective of the present invention is to provide a thread feeding method in which a color of a thread fed to the same line of a textile machine can be changed as required.

Still another objective of the present invention is to provide a thread feeding method in which digital data of figures or letters to be expressed on fabrics can be used for automation.

Still another objective of the present invention is to provide a thread feeding method which can significantly increase the number of colors to be expressed on fabrics, compared to a conventional technology.

Still another objective of the present invention is to provide a thread feeding method in which various colors can be expressed on fabrics in a textile machine by mixing various colors through an RGB (red-green-blue) mechanism or a CMYK (cyan-magenta-yellow-black) mechanism.

Still another objective of the present invention is to provide a warp thread feeding method in which the color of a warp thread in each warp line fed to a weaving machine can be variously adjusted.

Still another objective of the present invention is to provide a weaving method which can express various colors or shades.

Still another objective of the present invention is to provide a thread feeder for realizing the method of the present invention.

Technical Solution

In accordance with an aspect of the present invention, there is provided a warp thread feeding method for feeding a warp by a weaving machine, wherein a plurality of strands of yarns are fed with intervals therebetween, to each line of warp thread feeding lines, while some strands of the plurality of strands of yarns, to be disposed on an upper surface of a first weft, are separated from the rest of the strands of yarns, and fed to the weaving machine, based on target colors or shades on the upper surface at a spot where the strands are woven by combining with the first weft, so that colors or shades of the separated strands to be disposed on the upper surface of the first weft, are combined to express the target colors or shades on the upper surface at the spot where the strands are woven by combining with the first weft.

The plurality of strands of yarns fed to each line of the warp thread feeding lines may have different colors.

In this case, the plurality of strands of yarns preferably include a plurality of yarns having the same color.

In some cases, yarns with the same color may be used. In this case, the roughness of the surface of fabrics to be woven may be variously expressed by varying the number of yarns to be disposed on the surface of the weft.

The plurality of strands of yarns may be fed to one warp thread feeding line in such a manner a total of 25 strands of yarns with 5 colors are fed, and each color group including 5 strands has the same color.

In some cases, the plurality of strands of yarns may include three-colored yarns.

Also, in some cases, the plurality of strands of yarns may include black yarns and white yarns.

In some cases, the separated rest of the strands may be divided into some strands to be disposed on a rear surface of a second weft, and other strands to be disposed between the first weft and the second weft, and fed to the weaving machine, based on target colors or shades on the surface at a spot where the strands are woven by combining with the second weft, so that colors or shades of the separated strands to be disposed on the rear surface of the second weft, are combined to express the target colors or shades on the rear surface at the spot where the strands are woven by combining with the second weft. This makes double-sided weaving. In this case, it is possible to express the front figure of a person, etc. on the upper surface of the fabrics and to express the rear figure corresponding to the front figure of the person, etc. on the rear surface of the fabrics.

In accordance with another aspect of the present invention, there is provided a thread feeding method for feeding threads to a textile machine, wherein a plurality of strands of yarns are fed with intervals therebetween, to each line of warp thread feeding lines, while some strands of the plurality of strands of yarns are separated from the rest of the strands and fed to the textile machine, based on target colors or shades at a spot where the strands are woven or embroidered, so that colors or shades of the separated strands are combined to express the target colors or shades at the spot where the strands are woven or embroidered.

In accordance with a further aspect of the present invention, there is provided a weaving method including: a yarn feeding step for feeding a plurality of strands of yarns with intervals therebetween to each line of warp thread feeding lines; a first yarn separating step for separating some strands of the plurality of strands of yarns to be disposed on an upper surface of a first weft, from the rest of the strands based on target colors or shades on the upper surface at a spot where the strands are woven by combining with the first weft, in each line of the warp thread feeding lines; and a first weft inserting step for inserting the first weft between the separated yarns, wherein through repeating performances of the steps, the strands to be disposed on the upper surface of the first weft, separated in the yarn separating step, are disposed on the surface of the first weft while colors or shades of the separated strands to be disposed on the upper surface of the first weft are combined to express the target colors or shades on the surface at the spot where the strands are woven by combining with the first weft.

In some cases, the weaving method may further include: a second yarn separating step for separating, from among the separated rest of the strands, some strands to be disposed on a rear surface of a second weft, and other strands to be disposed between the first weft and the second weft, based on target colors or shades on the surface at a spot where the strands are woven by combining with the second weft; and a second weft inserting step for inserting the second weft between the yarns separated in the second yarn separating step, wherein through repeating performances of the yarn feeding step, the second yarn separating step, and the second weft inserting step, colors or shades of the separated strands to be disposed on the rear surface of the second weft are combined to express the target colors or shades on the rear surface at the spot where the strands are woven by combining with the second weft.

Also, in the thread feeding method according to the present invention, from among a plurality of strands of yarns having two or more kinds of colors, 2 or more strands may be extracted and combined with each other to fabricate a thread with a mixed-color or a mixed-concentration during the threads are fed.

In accordance with a still further aspect of the present invention, there is provided a thread feeder for feeding threads to a textile machine, the thread feeder including: a yarn feeding means on which a plurality of strands of yarns to be fed to each line of thread feeding lines are wound; a yarn moving mechanism connected to each of the yarns loosen from the yarn feeding means, which is for dividing the yarns into two or more groups in each line and disposing the yarns while moving the yarns and leaving intervals therebetween; and a control means for applying a control signal for controlling an operation of the yarn moving mechanism, to the yarn moving mechanism, according to input weaving data or input embroidery data on fabrics to be woven.

The yarn moving mechanism may include catching members formed with catching parts for catching the yarns, and a solenoid mechanism for pushing or pulling each of the catching members.

At a front side and a rear side of the yarn moving mechanism, a front yarn guide and a rear yarn guide are preferably disposed, respectively, the front yarn guide and the rear yarn guide being divided into a plurality of spaces allowing the plurality of yarns to be passed through.

Advantageous Effects

The number of colors and the concentration of shade, expressed on fabrics according to the present invention can be variously expressed.

Also, since a color or a shade concentration to be expressed on fabrics according to the present invention can be variously adjusted through an RGB (red-green-blue) mechanism or a CMYK (cyan-magenta-yellow-black) mechanism, in other words, various colors can be expressed by mixing various colors, it is possible to express various colors by limited several colors of yarns.

In some cases, the number of strands of yarn disposed on the surface of a weft can be adjusted to adjust the surface roughness.

The color or the shade concentration of a thread being fed to a textile machine in the same thread feeding line can be changed, and thus it is very easy to automate expressing the surface of figures or letters to be expressed using digital data on the figures or letters.

DETAILED DESCRIPTION OF THE INVENTION

Best Mode for the Invention

Hereinafter, preferred exemplary embodiments of the present invention will be described in detail with reference to the accompanying drawings.

Figure 1:
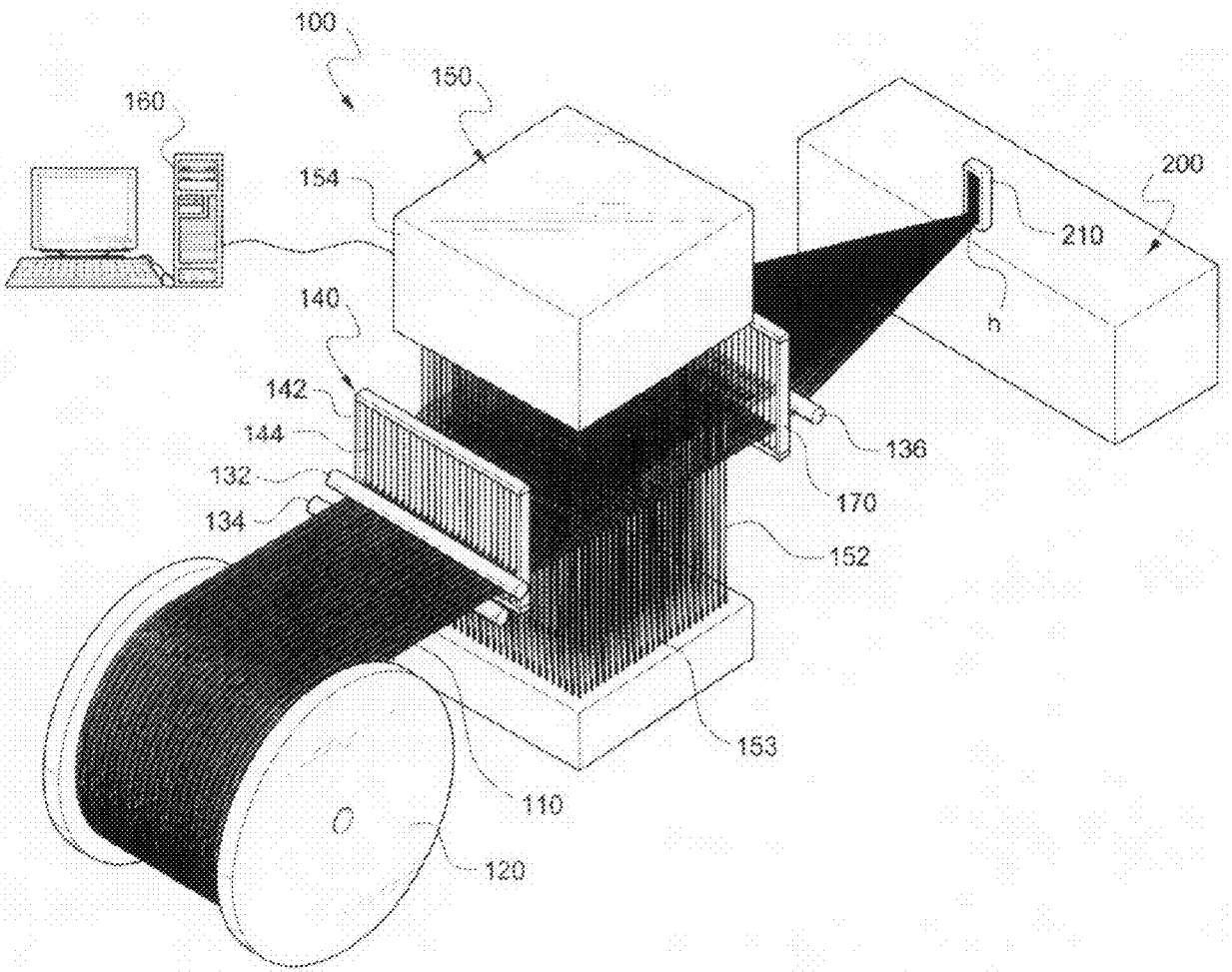
FIG. 1 is a perspective view showing an example of a thread feeder according to the present invention.
Figure 2:
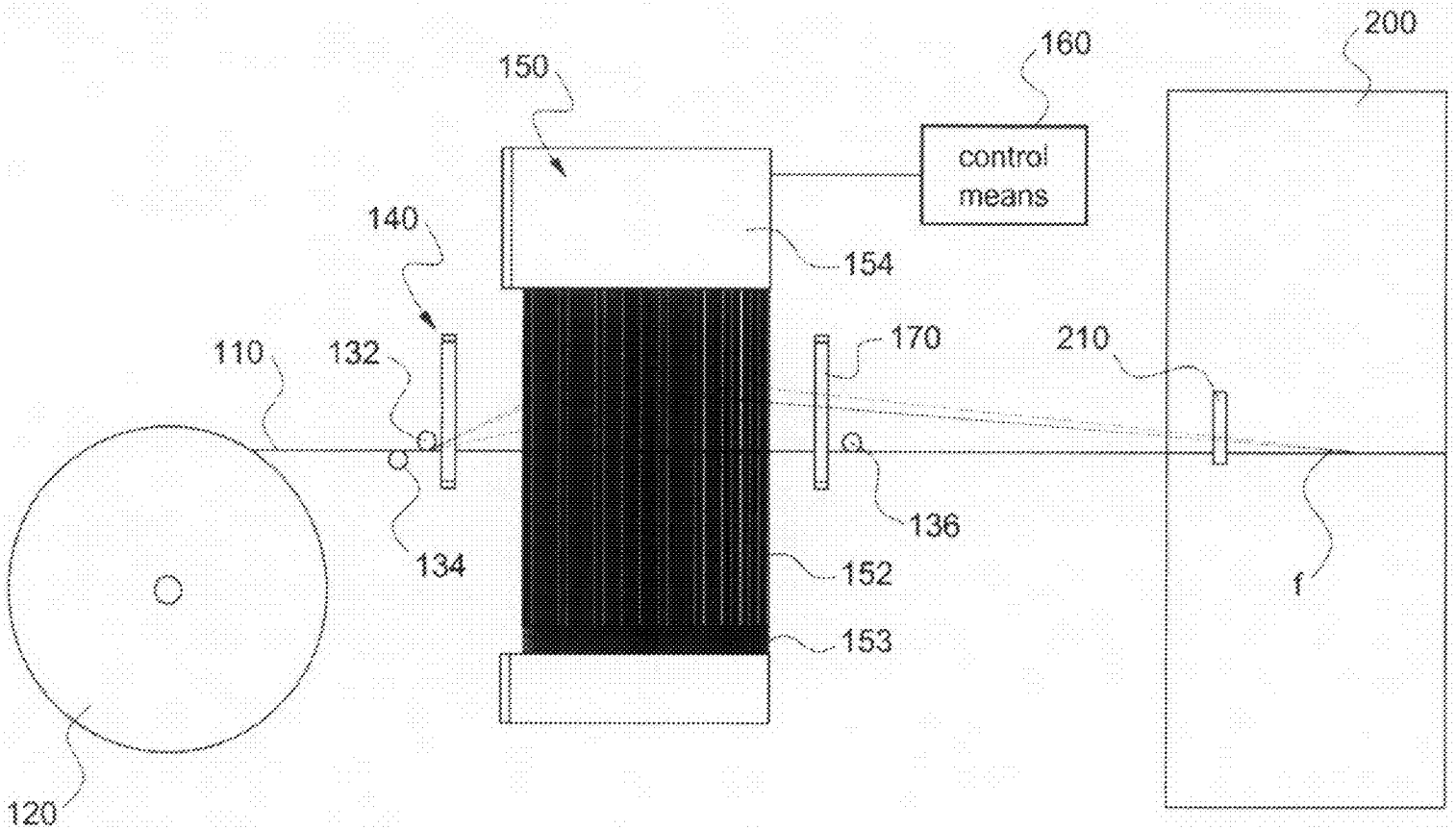
FIG. 2 is a side view showing the thread feeder shown in FIG. 1.
Figure 3:
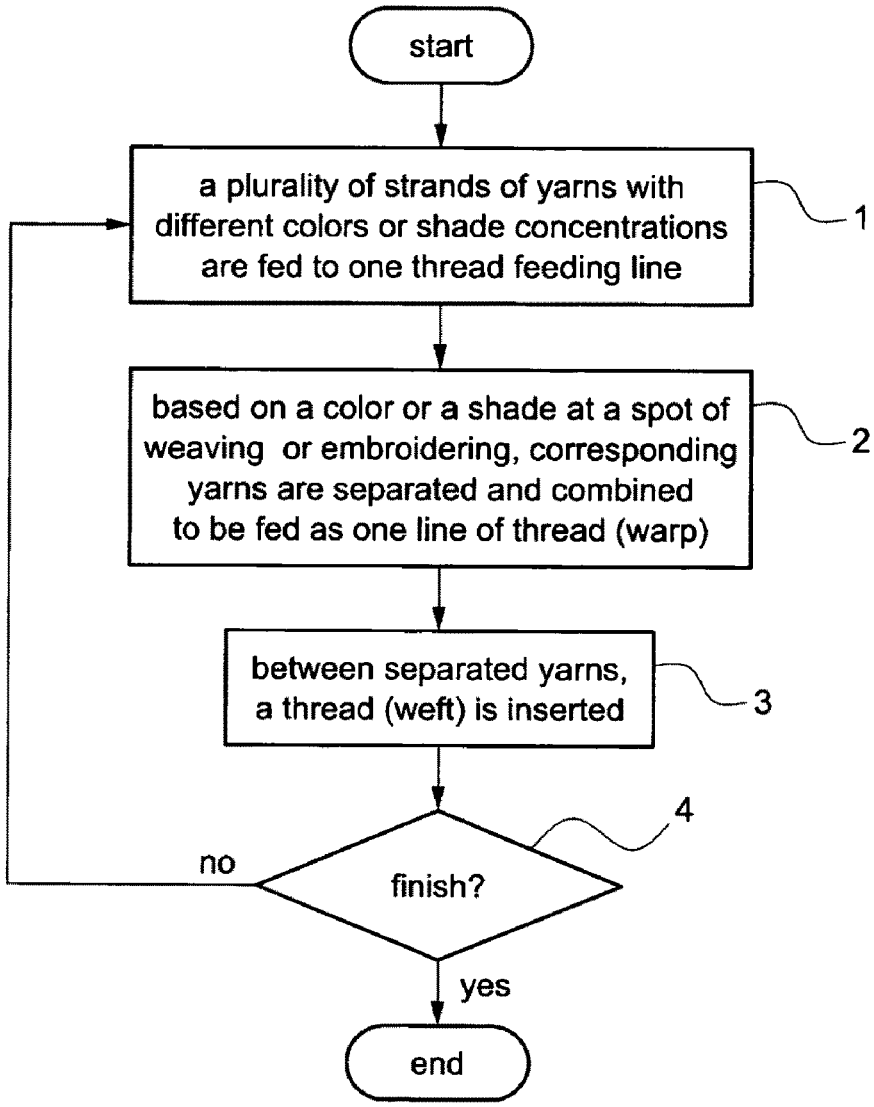
FIG. 3 is a flow chart illustrating a thread feeding method according to the present invention, realized in the feeder shown in FIG. 1.

FIG. 1 is a perspective view showing an example of a thread feeder according to the present invention, FIG. 2 is a side view showing the thread feeder shown in FIG. 1, and FIG. 3 is a flow chart illustrating a thread feeding method according to the present invention, realized in the feeder shown in FIG. 1.

As shown in FIGS. 1 to 3, a thread feeder 100 according to the present invention includes a yarn feeding means. The yarn feeding means is a part for feeding a plurality of strands of yarn 110 to each of thread feeding lines L of a textile machine, and includes a yarn drum 120, or the like. In the yarn drum 120, a black yarn, a white yarn, a yellow yarn, a blue yarn, and a red yarn are repeatedly arranged five times for one thread feeding line L, so that a total of 25 strands of yarn 110 are wound. The number of lines to be fed from one yarn drum 120, and the number of yarn drums may be determined according to the size, etc. of a weaving machine or an embroidery machine.

At the front side of the yarn drum 120, upper/lower guide rollers 132 and 134 for yarns 110 are disposed, and adjacently to the guide rollers 132 and 134, a front yarn guide 140 is provided.

The guide rollers 132 and 134 prevent the yarns 110 at the front side from undergoing influences when a yarn moving mechanism 150 as described below raises selected yarns 110.

The front yarn guide 140 separates the yarns 110 from each other by the unit of each thread feeding line L, and thus prevents them from getting tangled or foul while guiding them. The front yarn guide 140 is divided into a plurality of spaces by division members 144 which are provided leaving intervals therebetween in the width direction of the yarns 110 within a rectangular frame 142. One space corresponds to one thread feeding line L. In the present embodiment, through each thread feeding line, 25 strands of yarn 110 are passed.

At the front side of the front yarn guide 140, the yarn moving mechanism 150 is provided. The yarn moving mechanism 150 includes catching members 152 which are connected, respectively, to yarns 110 coming from the yarn drum 120. In each of the catching members 152, a catching part for catching the yarn 110 is formed, which will be described below, in detail. The catching members 152 are connected, respectively, to solenoid mechanisms 154. In some cases, beneath the catching members 152, an elastic body 153 may be connected so that the catching members 152 can be elastically pulled down, or other solenoid mechanisms may be provided so that the catching members 152 can be pulled upward or downward. The solenoid mechanism 154 is connected to a control means 160. The control means 160 applies a control signal for controlling the operation of the yarn moving mechanism 150, to the yarn moving mechanism 150, according to input weaving data or input embroidery data on fabrics to be woven, and then divides the yarns 110 into two groups while upwardly pulling some of the yarns 110, and leaving others as they are. For example, at a point of time of weaving or embroidering, the yarns may be raised, in such a manner that when a thoroughly red thread is required, 5 strands of red yarn are raised, and when an orange thread is required, 2 strands of red yarn and 3 strands of yellow yarn are raised according to a corresponding concentration. The yarns 110 raised in this manner are combined with each other so that they are shown as a combined color to a person's eye. Also, in order to obtain a violet-based brown color, 1 to 3 strands of red yarn, blue yarn, and yellow yarn may be raised respectively and combined with each other. In such a case, threads with various colors can be obtained.

Also, in come cases, several strands of black and white yarn may be used and combined with only a black/white degrees of shade so as to express figures or letters on fabrics.

Such a yarn moving mechanism 150 performs a role of dividing the yarns 110 in each line into two or more groups and disposing the divided groups while moving the selected yarns 110 with intervals therebetween.

In some cases where weaving or embroidering is carried out with both upper/lower surfaces, the yarns may be divided into three groups including upwardly-pulled yarns, downwardly-pulled yarns, and the rest. In this case, it is possible to variously express figures or letters on the upper surface and the lower surface of the fabrics to be woven or embroidered.

At the front side of the yarn moving mechanism 150, a rear yarn guide 170 is disposed. The rear yarn guide 170 also has the same shape as that of the front yarn guide 140, and has approximately the same function as that of the front yarn guide 140 except for its provided position.

At the front side of the rear yarn guide 170, a guide roller 136 is disposed. The guide roller 136, after the yarns 110 are divided into upper and lower two groups, is inserted between the two groups of yarn 110 so as to prevent the lower group of the yarn 110 from being raised.

The yarns 110 divided into upper and lower groups, as described above, are fed to a yarn guide 210 of a weaving machine 200. The yarn guide 210 of the weaving machine 210 is narrowly formed so as to perform a role of collecting the divided yarns 110 to one spot, and at the same time to prevent the collected yarns from getting tangled or foul.

Between the yarns 110 of respective lines, divided into upper and lower groups as described above, wefts f are inserted. Accordingly, on the upper surface of the wefts f, threads with colors obtained combining yarns 110 based on weaving data, etc. are disposed, while on the lower surface of the wefts f, other threads obtained combining the rest of the yarns 110 are disposed.

Hereinafter, a process where threads are fed to the weaving machine 200, or the like through the thread feeder 100 as described above, and woven, will be described with reference to FIG. 3.

The yarn drum 120 is provided in the neighborhood of a textile machine such as the weaving machine 200 in such a manner that it can be rotated. The yarn drum 120 is rotated by the weaving machine 200's force pulling the yarns 110 while unloosing the yarns 110. Of course, in order to facilitate the rotation of the yarn drum 120, it is possible to transfer of rotating power from a servo motor, or the like.

While the yarns 110 wound on the yarn drum 120 are loosened, a plurality of strands of yarns 110 are fed to respective thread feeding lines L. The yarns 110 fed to the respective lines L include different colors or different black/white shade concentrations. Preferably, a plurality of strands of yarns 110 with the same color are fed to each of the thread feeding lines L (step 1).

Herein, the control means 160 applies a control signal to the yarn moving mechanism 150 according to a color or a black/white shade concentration to be expressed on the upper surface of a weft f at a spot where the yarns are to be woven by combining with the weft f. Accordingly, the solenoid mechanisms of the yarn moving mechanism 150 which has received the control signal for upwardly pulling the connected yarns 110 are operated while upwardly pulling certain catching members 152. Accordingly, the yarns 110 caught in the corresponding catching members 152 are raised while being separated from the rest of the yarns 110, as shown in FIGS. 1 and 2. In other words, the yarns 110 are divided into two groups. In this state, the guide roller 136 at the rear side is advanced between the divided two groups of yarn 110 and slightly presses the yarns 110 at the lower side, so that the yarns 110 can be separated to exact positions even in the neighborhood of the weaving machine 200. Then, the guide roller 136 is escaped from the two groups of the yarns 110 and is returned to its original position. Through this process, the thread is fed to the weaving machine 200, and the yarns 110 divided into upper and lower two groups are combined with each other respectively by passing through the yarn guide 210 of the weaving machine 200, and are fed as one line of thread, that is, a warp (step 2).

At the front side of the yarn guide 210, the weft f is inserted between the divided two groups of yarn 110 (step 3).

Then, it is determined if there is a finish signal from the control means 160. Then, when the finish signal exists, the process is ended, and when the finish signal does not exist, steps 1 to 3 are repeated (step 4).

In a case where weaving or embroidering is carried out by feeding threads, through the above described process, an image to be woven may be obtained through scanning, photographing, or a computer graphic work, from which RGB or CMYK digital data on the image can be obtained and then can be easily utilized as weaving or embroidering data.

Figure 4:
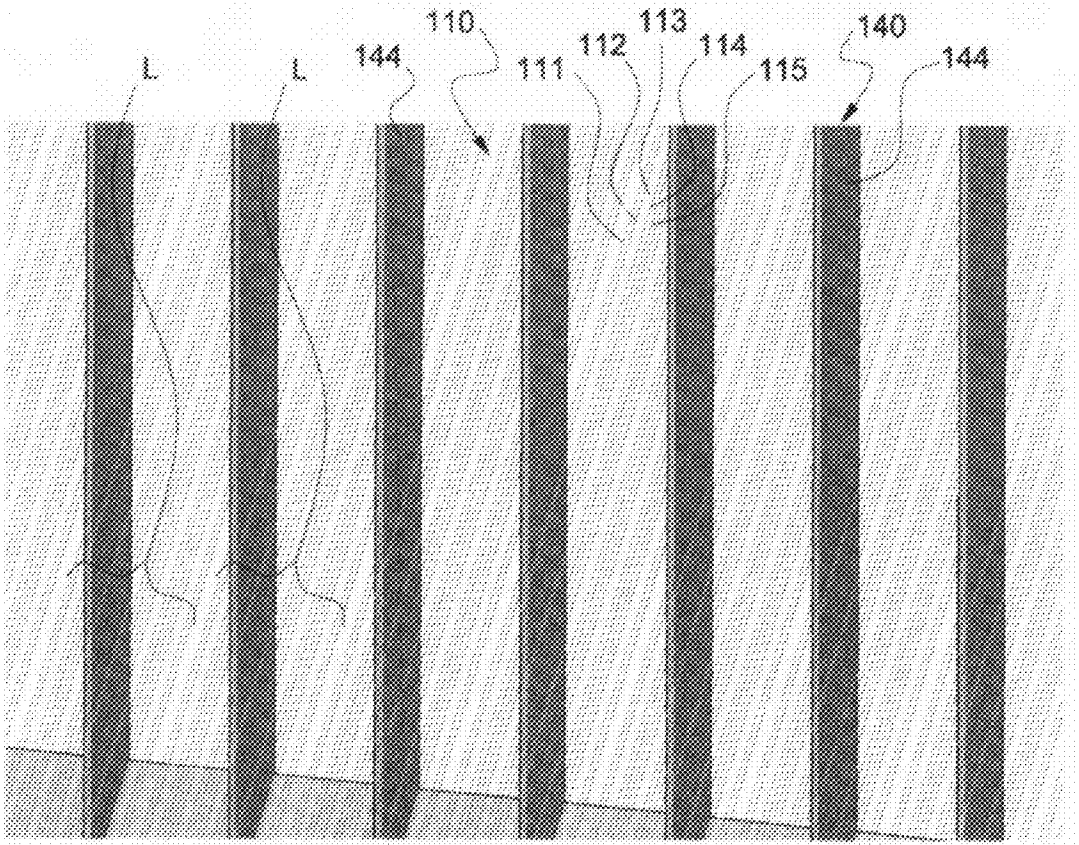
FIG. 4 is a partially enlarged view of a front yarn guide, which shows the state where yarns are passed through the front yarn guide.

FIG. 4 is a partially enlarged view of a front yarn guide, which shows the state where yarns are passed through the front yarn guide.

As shown, through two adjacent division members 144 of the front yarn guide 140, the yarns 110 are passed. Within each gap between adjacent members 144, one thread feeding line L is formed. In the present embodiment, the yarns 110 passing through one thread feeding line L are disposed in such a manner that a red yarn 111, a blue yarn 112, a yellow yarn 113, a white yarn 114, and a black yarn 115 are repeatedly disposed five times, so that a total of 25 strands of yarn are passed. In this manner, to one thread feeding line L, 5 strands of red yarn 111, 5 strands of blue yarn 112, 5 strands of yellow yarn 113, 5 strands of white yarn 114, and 5 strands of black yarn 115, that is, a total of 25 strands of yarn 110, are fed. Of course, the yarns 110 are arranged at intervals from their adjacent yarns.

There is no need to arrange the yarns 110 fed to the respective lines, with the same pattern. The arrangement of colors of the yarns 110 to be disposed in the respective lines L may vary according to the amount of color of the corresponding position of figures or letters to be woven.

Figure 5:
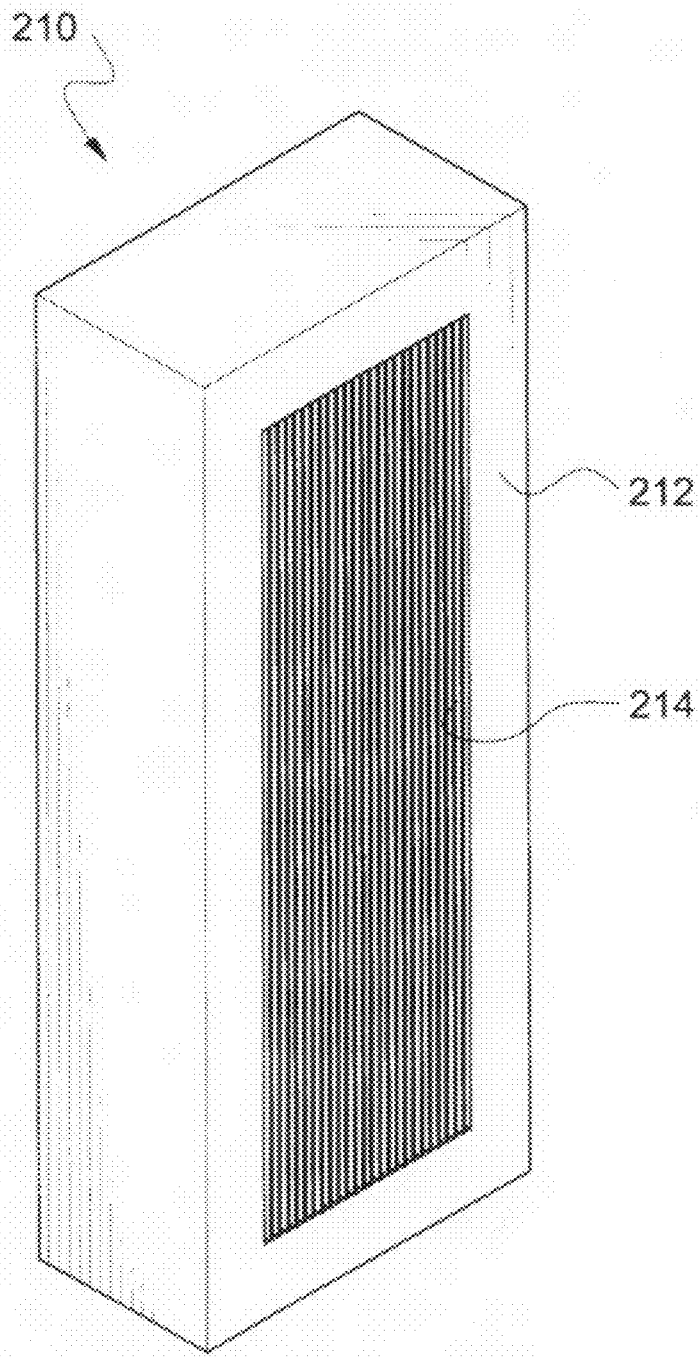
FIG. 5 is a perspective view showing a yarn guide for collecting yarns.

FIG. 5 is a perspective view showing a yarn guide for collecting yarns.

The yarn guide 210 shown in FIG. 5 is generally used in the weaving machine 200, and has a rectangular frame 212 with a high height and a narrow width, within which division members 214 are narrowly provided leaving intervals therebetween. In the division members 214 provided in the yarn guide 210, parts having possibilities of being in contact with the yarns 110 have to be formed in a round shape so that the yarns 110 are not easily worn or broken by getting in contact with the parts.

Figure 6:
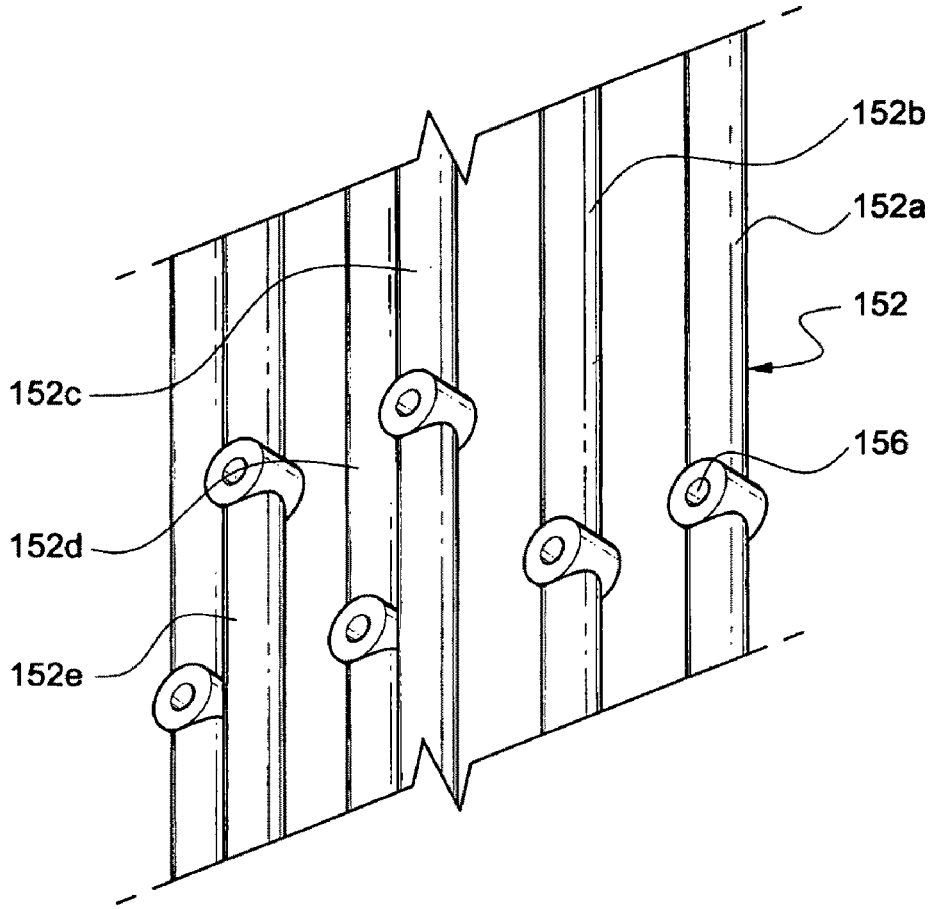
FIG. 6 is a partially enlarged view of a catching member.

FIG. 6 is a partially enlarged view of a catching member.

As shown, in one part of the catching member 152, a whole-shaped catching part 156 through which the yarns 110 can be passed is formed.

In other words, each of the yarns 110 fed from the yarn drum 120 is passed through the catching part 156 by being caught in the catching part 156 of the catching member 152 while being raised or not being raised. In FIG. 6, the catching members 152*c* and 152*e* at third and fifth positions from the right side are moved upward, and the rest of the catching members, that is, three catching members 152*a*, 152*b*, and 152*d* are not raised.

Figure 7:
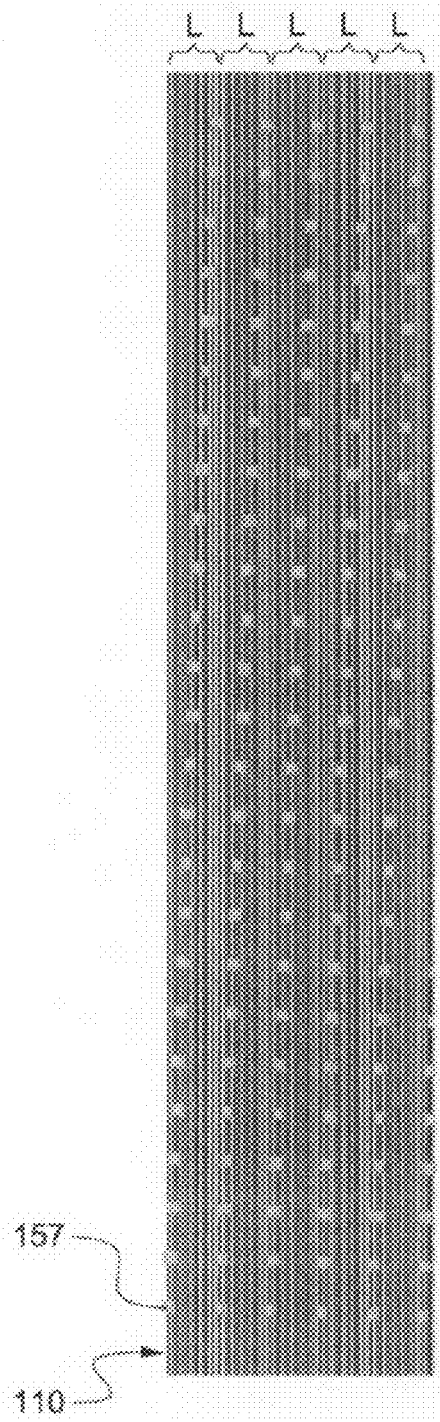
FIG. 7 is a plan view showing the state where the catching parts of the catching members, respectively, are connected to yarns.

FIG. 7 is a plan view showing the state where the catching parts of the catching members, respectively, are connected to yarns.

As shown in FIG. 7, to each feeding line L of a thread to be fed to the weaving machine, 25 strands of yarn 110 are fed. To the 25 strands of yarn 110, the catching parts 156 of the above described catching members 152 are connected, respectively. FIG. 7 shows a plan view of the connection points 157 between the yarns 110 and the catching parts 156.

In FIG. 7, for one of thread feeding lines L, 25 connection points 157 are successively disposed at regular intervals between upper and lower points from the lower left edge to the upper right edge. Also, in its adjacent feeding line L, the connection points 157 are disposed in the same disposition manner. Accordingly, as the above described solenoid mechanisms 154 are operated, in each feeding line L, the yarns 110 selected from among 25 yarns based on weaving data, etc. can be raised and separated from the rest of the yarns.

Figure 8:
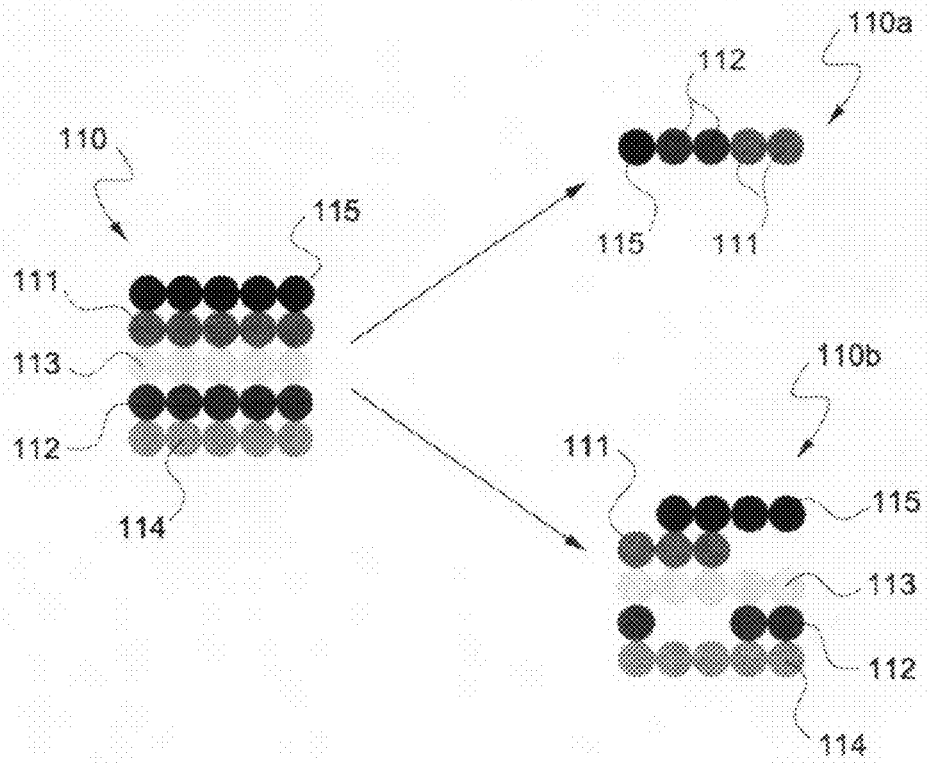
FIG. 8 is a view more specifically illustrating the concept of a thread feeding method according to the present invention.
Figure 9:
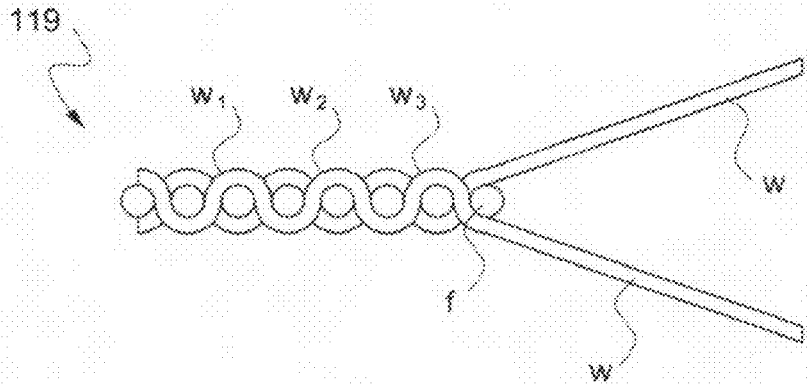
FIG. 9 is a view partially showing one example of fabrics woven according to the method of the present invention.

FIG. 8 is a view more specifically illustrating the concept of a thread feeding method according to the present invention, and FIG. 9 is a view partially showing one example of fabrics woven according to the method of the present invention.

As described above, in a case where a total of 25 strands of yarn 110, including 5 strands of black yarn 115, 5 strands of red yarn 111, 5 strands of yellow yarn 113, 5 strands of blue yarn 112, and 5 strands of white yarn 114, are fed, to one thread feeding line, 1 strand of black yarn 115, 2 strands of blue yarn 112, and 2 strands of red yarn 111 are extracted from among the yarns and separated from the rest of the yarns 110*b*. The five strands of yarn 110*a* separated as described above are disposed on the upper surface of the fabrics through combination, so as to express a violet-based color, while the rest of the yarns 110*b* may be disposed on the rear surface of the fabrics or used for multiple-weaving, such as double-weaving or more layer-weaving, through re-separation.

According to the method of the present invention, in fabrics 119 shown in FIG. 9, in the warp w on the upper surface of the weft f, the colors of the warp w in the same line may be expressed in such a manner that a first point w1 is violet, a second point w2 is orange, and a third point w3 is brown. Also, the lower surface of the weft f may be expressed in the same manner as the upper surface.

Although in the description of the preferred embodiment of the present invention, a total of 25 strands of yarn 110 with 5 colors, in which each group of 5 yarns 110 has the same color, are fed to one thread feeding line L, the color and the number of yarns may vary according to the kind or condition of fabrics to be woven, and the color or brightness of a figure to be expressed.

Industrial Applicability

The thread feeding method, the warp thread feeding method, the thread feeder and the weaving method, as described above, according to the present invention, can be utilized to express patterns, figures, and letters, with colors or shades, on the fabrics.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A warp thread feeding method for feeding a warp by a weaving machine comprising the steps of:

feeding a plurality of strands of yarns at intervals therebetween, to each line of warp thread feeding lines, separating some strands of the plurality of strands of yarns, to be disposed on an upper surface of a first weft from the rest of the strands of yarns based on a first target color or shade on the upper surface at a spot where the strands are woven by combining with the first weft and feeding the separated some of the strands to the weaving machine so that the first target color or shade is expressed by the combination of colors or shades of the some strands on the upper surface at the spot where the strands are woven by combining with the first weft, wherein the plurality of strands of yarns fed to each line of the warp thread feeding lines have different colors.

2. The warp thread feeding method as claimed in claim 1, wherein the plurality of strands of yarns comprise a plurality of yarns having the same color.

3. The warp thread feeding method as claimed in claim 2, wherein the plurality of strands of yarns are fed to one warp thread feeding line in such a manner a total of 25 strands of yarns with 5 colors are fed, and each color group comprising 5 strands has the same color.

4. The warp thread feeding method as claimed in claim 1, wherein the plurality of strands of yarns comprise three-colored yarns.

5. The warp thread feeding method as claimed in claim 1, wherein the plurality of strands of yarns comprise black yarns and white yarns.

6. The warp thread feeding method as claimed in claim 1, further comprising the steps of:

separating the rest of the strands into some strands to be disposed on a rear surface of a second weft, and other strands to be disposed between the first weft and the second weft, based on a second target color or shade on the surface at a spot where the strands are woven by combining with the second weft, and feeding the separated the rest of the strands to the weaving machine so that the second target color or shade on the rear surface of the second weft is expressed by combination of colors or shades of the some strands of the rest of the strands.

7. A thread feeder for feeding threads to a textile machine, the thread feeder comprising: a yarn feeding means on which a plurality of strands of yarns to be fed to each line of thread feeding lines are wound; a yarn moving mechanism connected to each of the yarns loosen from the yarn feeding means, which is for dividing the yarns into two or more groups in each line and disposing the yarns while moving the yarns and leaving intervals therebetween; and a control means for applying a control signal for controlling an operation of the yarn moving mechanism, to the yarn moving mechanism, according to input weaving data or input embroidery data on fabrics to be woven, wherein the yarn moving mechanism performs the steps of separating some strands of the plurality of strands of yarn from the rest of the strands and feeding the separated strands to the textile machine, based on a target color or shade at a spot where the strands are woven or embroidered, so that the target color or shade is expressed by combination of colors or shades of the some strands according to the control signal, wherein the plurality of strands of yarns fed to each line of the thread feeding lines comprise a plurality of strands of yarns having different colors mutually.

8. The thread feeder as claimed in claim 7, wherein the yarn moving mechanism comprises catching members formed with catching parts for catching the yarns, and a solenoid mechanism for pushing or pulling each of the catching members.

9. The thread feeder as claimed in claim 7, wherein at a front side and a rear side of the yarn moving mechanism, a front yarn guide and a rear yarn guide are disposed, respectively, the front yarn guide and the rear yarn guide being divided into a plurality of spaces allowing the plurality of strands of yarns to be passed through.

10. A thread feeding method for feeding threads to a textile machine comprising:

feeding a plurality of strands of yarns at intervals therebetween, to each line of thread feeding lines, separate some strands of the plurality of strands of yarns from the rest of the strands and feeding the separated some strands to the textile machine, based on a target color or shade at a spot where the strands are woven or embroidered, so that the target color or shade is expressed by combination of colors or shades of the some strands, wherein the plurality of strands of yarns fed to each line of the thread feeding lines comprise a plurality of strands of yarns having different colors mutually.

11. A weaving method comprising:

a yarn feeding step for feeding a plurality of strands of yarns with intervals therebetween to each line of warp thread feeding lines;

a first yarn separating step for separating some strands of the plurality of strands of yarns to be disposed on an upper surface of a first weft, from the rest of the strands based on a target color or shade on the upper surface at a spot where the strands are woven by combining with the first weft, in each line of the warp thread feeding lines; and a first weft inserting step for inserting the first weft between the separated yarns, wherein through repeating performances of the steps, the strands to be disposed on the upper surface of the first weft, separated in the yarn separating step, are disposed on the surface of the first weft while colors or shades of the separated strands to be disposed on the upper surface of the first weft are combined to express the target colors or shades on the surface at the spot where the strands are woven by combining with the first weft and wherein the plurality of strands of yarns fed to each line of the thread feeding lines comprise a plurality of strands of yarns having different colors mutually.

12. The weaving method as claimed in claim 11, further comprising a second yarn separating step for separating, from among the separated rest of the strands, some strands to be disposed on a rear surface of a second weft, and other strands to be disposed between the first weft and the second weft, based on a target color or shade on the surface at a spot where the strands are woven by combining with the second weft; and a second weft inserting step for inserting the second weft between the yarns separated in the second yarn separating step, wherein through repeating performances of the yam feeding step, the second yam separating step, and the second weft inserting step, colors or shades of the separated strands to be disposed on the rear surface of the second weft are combined to express the target color or shade on the rear surface at the spot where the strands are woven by combining with the second weft.

* * * * *